US010895438B1

(12) United States Patent
Barker et al.

(10) Patent No.: US 10,895,438 B1
(45) Date of Patent: Jan. 19, 2021

(54) PROJECTILE BARRIERS

(71) Applicant: The Tisdale Group, Lebanon, TN (US)

(72) Inventors: Donald Wade Barker, Lebanon, TN (US); Christopher Haile, Lebanon, TN (US)

(73) Assignee: The Tisdale Group, Lebanon, TN (US)

( * ) Notice: Subject to any disclaimer, the term of this patent is extended or adjusted under 35 U.S.C. 154(b) by 0 days.

(21) Appl. No.: 16/170,200

(22) Filed: Oct. 25, 2018

Related U.S. Application Data

(60) Provisional application No. 62/578,283, filed on Oct. 27, 2017.

(51) Int. Cl.
*F41H 5/007* (2006.01)
*F41H 5/06* (2006.01)

(52) U.S. Cl.
CPC ..... *F41H 5/007* (2013.01)

(58) Field of Classification Search
CPC ..... F41H 5/007
USPC ..... 89/36.02; 102/303; 86/50
See application file for complete search history.

(56) References Cited

U.S. PATENT DOCUMENTS 7,575,797 B2 * 8/2009 Karr ..... E04H 9/10 428/116
8,592,351 B2 * 11/2013 Kaminsky ..... B01F 3/0811 166/266
8,993,079 B1 3/2015 Duong
2009/0004413 A1 * 1/2009 Wagner ..... B32B 5/22 428/34.1

* cited by examiner

*Primary Examiner* — Reginald S Tillman, Jr.
(74) *Attorney, Agent, or Firm* — Potomac Law Group, PLLC; Kenneth Fagin

(57) ABSTRACT

A high-speed projectile barrier is disclosed. The barrier includes a core structure and a layer or layers of insulation around the core, surrounded by outer skins. The core is made from liquid material that flows at room temperature and that solidifies at cryogenic temperatures, and filler material. The filler may be, e.g., cellulose, carbon nanotubes, carbon nanofibers, or other high-strength polymeric fibers. Other contemplated filler materials include natural or artificial, layered silicate minerals. A viscosity-enhancing additive may be included. A heat transfer element runs through or around the core and is used to freeze (i.e., solidify) the core. The layers of insulation may be vacuum layers and/or layers of foam rubber, aerogel, glass fiber insulation, or other suitable materials.

8 Claims, 1 Drawing Sheet

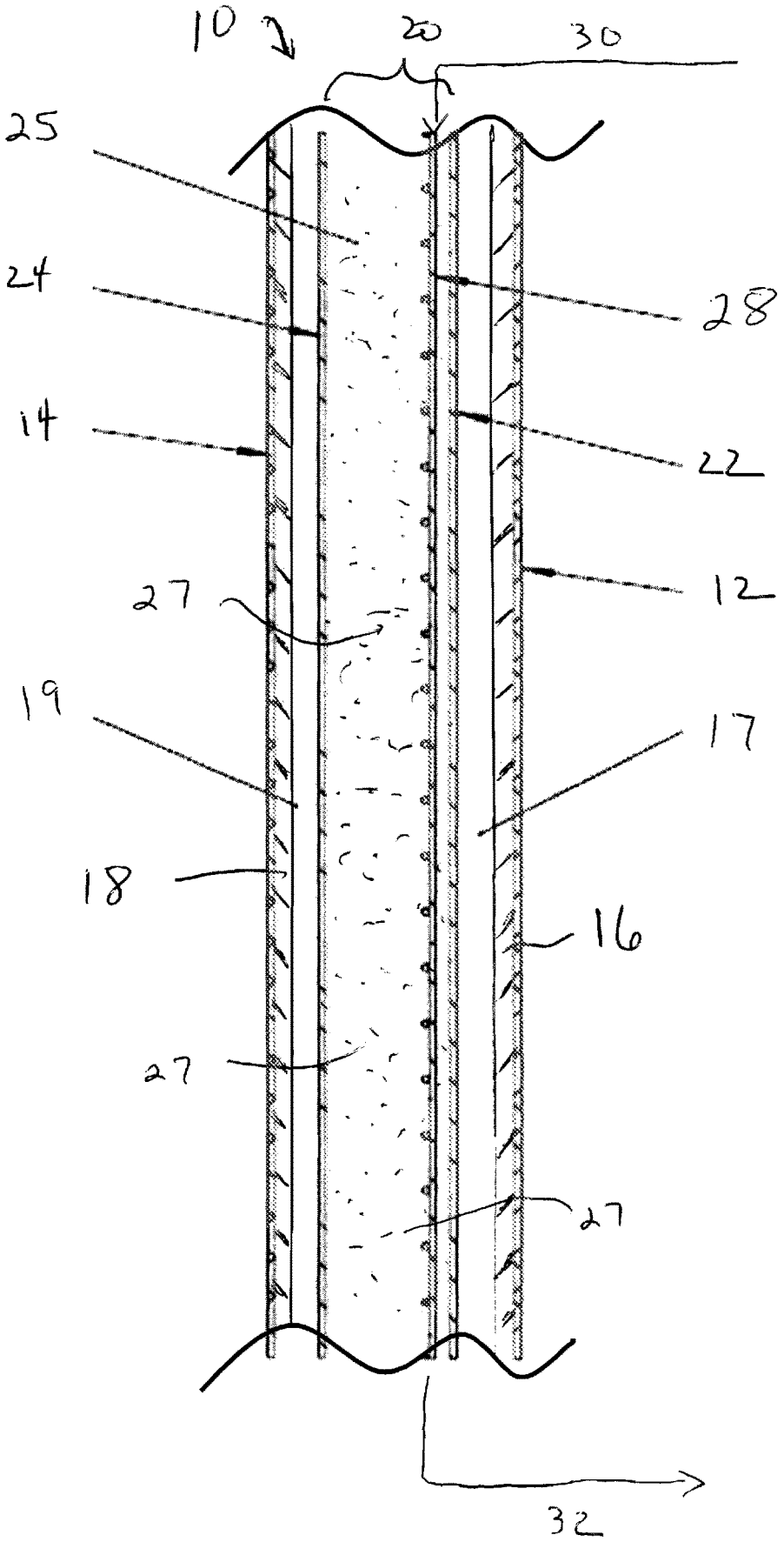
10
20
30
25
24
28
14
22
12
27
19
17
18
16
27
27
32

PROJECTILE BARRIERS

BACKGROUND OF THE INVENTION

1. Field of the Invention

In general, embodiments of the invention disclosed herein relate to protective barriers that stop or significantly reduce the velocity of high-speed projectiles.

2. Description of Related Art

There are a number of situations in which high-speed projectiles need to be stopped over a relatively short distance (e.g., on the order of 15-30 centimeters or less), preferably without allowing the projectile to pass through the barrier being used to arrest the projectile. Depending on the nature of and/or or the velocity of the projectile, this can be a difficult task. After all, given enough velocity, even a relatively light-weight object weighing on the order of a few tens of grams will have a high amount of kinetic energy and can cause a great deal of damage to whatever object it strikes.

One area in which the need to stop high-speed projectiles is particularly great is protecting those who serve and defend the population and the nation from gunfire and even more lethal means of attack. Conventionally in this regard, it is known to provide soldiers with body armor and vehicles with heavier armor plating. As for body armor, it may be made from materials such as ceramics or ceramic composites; vehicle armor, on the other hand, may traditionally be made as rolled homogenous armor (RHA), comprised of blocks of hot-rolled steel, and more recently, composite and ceramic armors.

Although the degree of protection afforded by modern armor has increased significantly over the years, there still remain certain drawbacks or limitations. For one, it tends to be fairly heavy, which can slow movement of armored vehicles as well as personnel. Additionally, certain armors—particularly RHA—need to be strengthened by subjecting them to intense pressure using pressure plates, and this can limit the shapes into which the armor panels are formed. And perhaps of most concern is the fact that as armor has developed, so, too, has the armor-penetrating capability of certain ordnances, e.g., explosively-formed penetrators (EFPs) and other improvised explosive devices.

SUMMARY OF THE INVENTION

In one aspect, the invention features a projectile barrier. The projectile barrier includes a core structure with a freezable material and filler material distributed throughout the freezable material; a heat-exchange member disposed in thermal communication with the freezable material; one or more thermally insulating layers disposed around the core structure; and external skins disposed on either side of the projectile. The projectile barrier has exceptional projectile-stopping power and is generally lighter-weight than conventional barriers such as body or vehicle armor. Additionally, constructing the projectile barrier using freezable material in its core structure facilitates making the projectile barrier in shapes more complex than simple flat panels.

In specific embodiments, the freezable material may be water, and the filler material may be one or more of carbon nanotubes, carbon nanofibers, paper pulp, ultra-high molecular weight polyethylene oriented strand materials, and para-aramid threads. Other contemplated filler materials include particles or nanoparticles derivable from larger layered mineral particles that are capable of being intercalated, including natural or artificial, layered silicate minerals such as montmorillonite, vermiculite, hectorite, saponite, hydrotalcites, kanemite, sodium octosilicate, magadite, and kenyaite. Mixed Mg and Al hydroxides may also be used. Various other clays can be used, such as claytone H.Y. Suitably, the filler material is present in an amount of up to about 10% by weight of the combination of freezable material and filter material.

The projectile barrier may also have a viscosity-enhancing additive such as xanthan gum admixed with the freezable material, e.g., in an amount of about 1% by volume of the combination of freezable material and viscosity-enhancing additive.

Other aspects, features, and advantages of the invention will be set forth in the description that follows.

BRIEF DESCRIPTION OF THE DRAWING FIGURE

The FIGURE is a schematic cross-sectional view of an embodiment of a projectile barrier in accordance with the claimed invention.

DETAILED DESCRIPTION

The FIGURE is a schematic cross-sectional view of a projectile barrier, generally indicated at 10, illustrating various inventive concepts. The projectile barrier 10 is illustrated in the FIGURE as having a generally panel-shaped configuration, with straight, parallel surfaces. However, this is for illustration purposes only, and in practice a projectile barrier 10 in accordance with the invention may have far more complex contours so as to conform closely to a soldier's anatomy or the particular curvature of a vehicle that is to be protected. In fact, the ability to construct projectile barriers with more complex geometries is one distinct advantage afforded by the construction arrangement of projectile barriers in accordance with the invention.

As further illustrated in the FIGURE, the projectile barrier 10 has first and second skins 12, 14; heat-transfer-inhibiting insulating layers 16, 18 under the skins 12, 14; and a core structure 20. The core structure 20 includes a container with metal or plastic walls 22, 24 and a freezable core material 25. By "freezable," it is meant that the core material 25 is a material such as water that, at least initially, will be liquid (or otherwise flowable) at room temperature, which allows the projectile barrier 10 to be formed in more complex shapes than just flat panels as noted above, and that will solidify (i.e., freeze) when it (the material, per se) is cooled to temperatures at or below the freezing point for the particular materials. Of course, although the use of water as the primary core material is advantageous for a number of reasons, including the fact that it is nontoxic and readily available, other fluids, and fluid mixtures, may be used in the core structure 20. Depending on the particular material used for the core material 25, that temperature may be as high as 0° C. for water, or it may be substantially colder, i.e., on the order of what would be termed "cryogenic" or "near-cryogenic" by those of skill in the art (0° F. to −180° F.). As addressed more fully below, the projectile barrier 10 is used with the core structure in the solidified (e.g., frozen) state.

Furthermore, the core structure 20 preferably includes one or more small-scale or nano-scale (i.e., on the order of 1-250 nanometers), particulate, fibrous, thread-like, flake-type, etc. solid filler materials 27 distributed throughout the core material 25, in which case the core material 25 forms a matrix fluid with a solid filler material 27. Suitably, the filler material 27 constitutes up to 10% by volume of the matrix/filler combination. The filler material(s) 27 may be a material such as carbon nanotubes, carbon nano-fibers, or paper pulp (e.g., cellulose fibers). In other embodiments, the filler may be a plastic polymer, such as ultra-high molecular weight polyethylene oriented strand materials (e.g., DYNEEMA® thread) or para-aramid synthetic fiber (KEVLAR® thread). Still further contemplated filler materials include particles or nanoparticles derivable from larger layered mineral particles that are capable of being intercalated, including natural or artificial, layered silicate minerals such as montmorillonite, vermiculite, hectorite, saponite, hydrotalcites, kanemite, sodium octosilicate, magadite, and kenyaite. Mixed Mg and Al hydroxides are also contemplated to be used. Various other clays might be used, such as claytone H.Y.

The core structure 20 may also include viscosity-enhancing additives that keep the core material 25 at a viscosity sufficient to ensure that the filler material 27 remains distributed within the fluid matrix when the core material 25 is not solidified. For example, the core material 25 may include water, with, e.g., up to 1% by volume of a viscosity-modifying additive such as xanthan gum or another suitable additive.

The skins 12, 14 are suitably made of a metal, such as aluminum, titanium aluminide (Ti-6Al—V), or steel (e.g., in the form of rolled homogeneous armor (RHA)), but need not be made of the same metal or in the same thickness as each other. For example, the skin that faces outward and that will be impacted by a projectile may have a thickness on the order of 25 mm, while the other skin may be thinner and have a thickness on the order of 12.5 mm. The particular thicknesses that are chosen for the skins 12, 14 may vary greatly, by an amount ranging from a few millimeters to at least several centimeters based on the nature of the energy or impact that the barrier 10 is designed to absorb as well as on the desired weight and other physical characteristics of the barrier 10. The barrier 10 also suitably has side skins or plates, which are not illustrated in the FIGURE.

As noted above, the projectile barrier 10 includes heat-transfer-inhibiting insulating layers 16, 18 between the skins 12, 14 and the core structure 20. The insulating layers 16, 18 may each comprise one or more layers of conventional, thermally insulating material such as rubber, neoprene, aerogel, or another such material that retards the transfer of heat into the core structure 20. Additionally, depending on how cold the core material 25 needs to be kept in order to keep it solid/frozen, it may be desirable to provide a sealed vacuum layer 17, 19 between each of the insulating layers 16, 18 and the core structure 20. Such a vacuum layer gives the panel the characteristics of a Dewar in that heat transmission by conduction is slowed or prevented. The insulating layers 16, 18 and, if present, vacuum layers 17, 19 help to control the thermal signature of the barrier 10 and to make it easier to handle when the core material 25 is frozen.

Finally, in terms of the construction of a projectile barrier 10 in accordance with the claimed invention, a heat-transfer element 28, which is used to cool and solidify the core material 25, is provided in thermal communication with the core material 25. The heat transfer element 28 may, for example, include a copper plate with a network of tubing through which coolant flows embedded within the core material 25, as illustrated in the FIGURE. In an alternate configuration (not illustrated), the heat transfer element may include a network of copper tubing surrounding the core material 25, either just inside the walls 22, 24 of the container or just outside the walls 22, 24 of the container (so long as heat readily flows across the walls 22, 24 of the container, from the core material 25 to the heat transfer element as may be the case when the container is made of metal).

To freeze the core material 25, refrigerant or cryogenic material is circulated through the heat-transfer element 28, as indicated schematically by arrows 30, 32. If a refrigerant is used instead of a cryogenic liquid, the heat transfer element 28 would serve as the evaporator in a traditional refrigeration cycle, with a compressor and expansion valve (not illustrated) provided in addition to an external compressor (not illustrated).

Liquid nitrogen ($LN_2$), propylene glycol, ethylene glycol, ethanol, or a refrigerant like trifluoromethane (R-23) may be used to cool and solidify the core material 25, with the particular cooling medium being selected depending on how much cooling the core material 25 requires to solidify. In practice, a cryogenic system such as a portable liquid nitrogen plant or, for a refrigerant, a heat pump system (neither illustrated) would circulate cryogenic fluid or refrigerant to the heat transfer element 28.

In various applications, the cryogenic system would be connected to a barrier 10 by a port and appropriate piping or tubing (not illustrated), and the heat transfer element 28 would be charged with a cryogen or refrigerant until the core material 25 has solidified. Depending on the application, cryogen or refrigerant may be circulated through the core structure 20 on a continuous or periodic basis to maintain the core material at low enough temperatures for it to remain solid, or the cryogen or refrigerant may be withdrawn or evacuated and the barrier 10 sealed, with the passive insulation being relied up to maintain temperature, at least for some period of time.

With the core material 25 maintained in a frozen state at low temperature (e.g., −100° F. (−73° C.) or lower), if an object breaches the outer skins 12, 14, the solid core material 25 will absorb the object's energy rapidly, suitably in most cases without allowing the object to fully transit the barrier 10. The rigidity of the core structure 20 offers protection, but water in particular is a compound with a high heat of fusion and a high heat of vaporization—i.e., converting it from a solid (ice) at cryogenic or near-cryogenic temperatures to a vapor (steam) requires a lot of energy compared with other materials. Thus, confronted with a large amount of energy, the core material 25 may rapidly melt and turn to steam, absorbing at least some of the kinetic energy of the projectile in the process. Meanwhile, the filler material 27 may alter the elastic modulus, toughness, or other mechanical properties of the frozen core material 25, or may control the rate or manner in which it is permitted to undergo phase transitions (e.g., solid to liquid) in response to impacts.

In general, we believe (but are not bound to the theory) that the filler material(s) 27 enhance the projectile-stopping capability of the barrier 10 in several different ways. First, they disrupt and therefore lengthen the fracture pathways through the frozen/solidified core material 25. With longer fracture pathways, more energy is dissipated as a projectile passes through the core structure 20, thereby causing the projectile to shed kinetic energy and hence velocity as it traverses the core structure 20.

Additionally, filler materials 27 strengthen/toughen the core material in terms of pure mechanical properties. In this regard, we have found the carbon nanofibers are particularly advantageous. This is because carbon nanofibers tend to have cup-shaped or donut-shaped projections along the length of the fiber. As the core material 25 solidifies, the fibers are compressed into tight engagement with each other, and the projections cause them to be interlocked into a strength-enhancing internal meshwork.

As yet another, more indirect way in which carbon nanofibers improve performance of projectile barriers 10 per the invention, we have noted that they raise the melt temperature of the core material 25 (at least when the core material is water) as compared to those situations when no filler material 27 is used. In fact, we have seen evidence suggesting that, at least once water core material has been frozen at least once, the melt temperature of the core material may be raised to as high as room temperature or even slightly more in a sort of hysteresis effect on the core material's melt temperature. This increase in the melt temperature makes it easier to solidify the core material 25 and keep it solid for longer periods of time.

Further still, we believe the fact that the core material 25 is liquid at room temperature also helps the projectile barrier 10 in its projectile-stopping function. In particular, assuming materials with lower freeze points will have lower vaporization temperatures and vaporize more easily than materials with higher freeze points, we believe it will be somewhat easier for the core material 25 to vaporize when a projectile strikes it than is the case for material that only melts at higher temperatures (e.g., metals). And as the core material 25 vaporizes, the transformation of state draws off kinetic energy, and hence velocity, from the projectile. Therefore, the liquid-at-room-temperature nature of the core material 25 should help the projectile barrier 10 dissipate kinetic energy of a projectile and slow or bring it to a stop.

Moreover, we note that certain munitions (e.g., EFPs) arrive at their target as a train of smaller projectiles. We believe that as vaporized core material 25 jets out of the projectile barrier 10 through the point of entry of the first projectile within the train, the air in front of the point of entry will be highly disturbed, and this disturbance may alter the trajectory of the subsequent projectiles within the train such that they do not follow the first projectile through the point of entry. This effect, it is believed, may reduce the destructiveness of such "trained" projectiles.

A projectile barrier 10 in accordance with the claimed invention may also be useful in application such as siding or other protective panels for housing and other types of buildings, especially in areas prone to hurricanes, tornadoes, and other such phenomena that tend to batter a structure with high winds and flying debris. For similar reasons, the projectile barrier 10 may also be useful as container walls for shipping containers, truck trailers, and the like, especially where protection during shipping is desirable.

When used for buildings, shipping containers, and trailers, an added benefit of the projectile barrier 10 is that the insulation 16, 18 can be specified so that the contents of the building or container are kept cold to a defined temperature.

If the vehicle or container in which the barriers 10 are installed is mobile, the barriers 10 may be charged, and their cores structures 20 frozen, by a cryogenic system located at a base of operations, fleet replenishment depot, etc. Self-contained liquid nitrogen plants are commercially available that can produce up to 240 L of liquid nitrogen per day from air. Many of those plants can run using solar power, if a power grid is not readily available. Alternatively, a small cryogenic system could be carried by the vehicle or container itself. If a refrigerant and heat pump system are used as the cryogenic system, then that system may also be used to cool the vehicle, as with a conventional heat pump or vehicle air conditioner. As a practical matter, with good insulation 16, 18 a single charge of refrigerant or cryogen will typically be sufficient, often for a matter of days or weeks, until and unless the barrier 10 is damaged.

The following non-limiting examples illustrate the particular structure, composition, and other properties of a projectile barrier 10.

Example 1: Computational Proof of Concept

An initial set of simulations were conducted to evaluate the performance of a simplified version of a barrier 10 in a ballistic projectile scenario. All simulations in this analysis were conducted using a Lagrangian solver with water ice only (composite was not modeled) using smooth particle hydrodynamics (SPH), which better captures the behavior of brittle fracture. The simulations utilized 2-D axisymmetric solutions.

An explosively-formed penetrator (EFP) was used as the ballistic projectile in this scenario. The EFP used in the simulations was based on the published results of an 88.9 mm diameter copper-lined weapon (Murphy, M. J., "Constitutive model parameter determination from generic EFP warhead tests," *J de. Physique IV, Colloque C*8, Vol. 4, p. 483, 1994). The slug of copper was 20 mm in diameter, 52 mm long, a rounded nose with a radius of 9 mm and a temperature of 1400K. Its velocity was set to 2520 m/s, which yielded a kinetic energy of roughly 450 kJ.

The Ti-6Al-4V material model was based on the work of Gooch and Burkins (*A Ballistic Evaluation of Ti-6Al-4V vs. Long Rod Penetrators*, William A. Gooch and Matthew Burkins, AMSRL-WM-TA, May 2001). Several simulations were made using a long rod Tungsten penetrator impacting a specimen of Ti-6Al-4V. The material properties were tuned such that the simulations matched the experimental penetrations reported in Gooch and Burkins. The simulation indicated that 100 mm (4 in) of Ti-6Al-4V was required to stop the modeled EFP. As a precursor to the simulation using ice as a part of the barrier, a simulation was also run with two spaced Ti-6Al-4V plates. Each of these plates was 25 mm in thickness and they were spaced 192 mm apart. The EFP penetrated the second plate with a residual velocity on the order of 1600 m/s. This simulation served as a control to demonstrate the effectiveness of the ice in greatly reducing the EFP velocity.

As there was no material model for ice or an ice composite, one had to be created. The material model developed used Johnson-Holmquist strength and a Johnson-Holmquist failure model. These models are typically those used to model brittle materials such as glass and ceramics. The model parameters of float glass were used as a starting point. Research into the material properties of ice enabled the modification of most of these material properties to better reflect the properties of ice.

For the simulated barrier, a front skin of 12.5 mm thick Ti-6Al-4V was used followed by roughly a 13 mm gap that represented the Aerogel, which was assumed to have no effect on the EFP. This was followed by 169 mm of ice, another 10 mm Aerogel gap, and then a back skin of 25 mm thick Ti-6Al-4V.

The velocity of the EFP at 28, 150, and 250 μs was recorded. At a time of 28 μs, the EFP had penetrated the front skin and was beginning to both compress and fracture the ice. At that time, the bulk of the EFP was still travelling at 2500 m/s. At a time of 150 μs the EFP had fully penetrated the ice, but its velocity had been reduced to 700 m/s. Finally, the rear skin arrested the velocity of the EFP by a time of 250 μs.

The simulation was terminated when the EFP reached a dead state, but the ice still had substantial velocity at this instant (the residual kinetic energy of the ice was roughly 7% that of the EFP before it struck the barrier). The simulation indicated that roughly 80% of the kinetic energy of the EFP had been transferred into the ice, which would produce significant amounts of steam.

Example 2

An EFP live fire test was conducted. Two separate tests were conducted using 12"×12"×6" blocks of the core material 25, doped with paper pulp as the filler material 27 and using no metallic skin or casing. This material was shot with IS1 warheads, which consist of a 0.08 lb (0.036 kg) copper liner and 0.39 lb (0.18 kg) of C-4 explosive. The simulated barriers were placed approximately 8 ft. from the warhead, and a 2025 aluminum (very soft) back plate was placed 4" behind the simulated barriers. The barriers successfully stopped the EFP (without a metallic casing) and prevented penetration of the aluminum back plate. Although there were shallow indentations in the aluminum back plate, they had no copper residue in them. This indicates that pieces of the ice gouged the aluminum, but that the projectile itself did not. The deepest the ice penetrated the alumin was 0.174 inches (0.44 cm).

As used in this description and in the appended claims, the term "about" refers to a range of plus or minus 5% of the stated value.

All references listed herein are hereby incorporated by reference in their entireties.

While the invention has been described with respect to certain embodiments, the description is intended to be exemplary, rather than limiting. Modifications and changes may be made within the scope of the invention, which is defined by the appended claims.

What is claimed is:

1. A projectile barrier, comprising:

a core structure comprising a freezable material with solid filler material distributed throughout the freezable material;

a heat-exchange member disposed in thermal communication with the freezable material, the heat-exchange member being constructed and arranged to remove heat from the freezable material to facilitate solidification of the freezable material;

one or more thermally insulating layers disposed around the core structure; and first and second external skins disposed on either side of the projectile barrier.

2. The projectile barrier of claim 1, wherein the freezable material comprises water.

3. The projectile barrier of claim 1, wherein the filler material comprises a material selected from the group consisting of carbon nanotubes, carbon nano-fibers, paper pulp, ultra-high molecular weight polyethylene oriented strand materials, and para-aramid threads.

4. The projectile barrier of claim 1, wherein the filler material comprises a material selected from the group consisting of montmorillonite, vermiculite, hectorite, saponite, hydrotalcites, kanemite, sodium octosilicate, magadite, kenyaite, mixed magnesium and aluminum hydroxides, and claytone H.Y.

5. The projectile barrier of claim 1, wherein the filler material is present in an amount of up to about 10% by volume of the combination of freezable material and filter material.

6. The projectile barrier of claim 1, further comprising a viscosity-enhancing additive admixed with the freezable material.

7. The projectile barrier of claim 6, wherein the viscosity-enhancing additive comprises xanthan gum.

8. The projectile barrier of claim 6, wherein the viscosity-enhancing additive is present in an amount of about 1% by volume of the combination of freezable material and viscosity-enhancing additive.

* * * * *